United States Patent [19]

Meyer

[11] 4,251,701

[45] Feb. 17, 1981

[54] CIRCUIT INTERRUPTER

[75] Inventor: Thomas N. Meyer, Murrysville, Pa.

[73] Assignee: Westinghouse Electric Corp., Pittsburgh, Pa.

[21] Appl. No.: 880,268

[22] Filed: Feb. 23, 1978

Related U.S. Application Data

[63] Continuation-in-part of Ser. No. 762,543, Jan. 26, 1977, abandoned.

[51] Int. Cl.[3] ..... H01H 33/88

[52] U.S. Cl. ..... 200/148 A; 200/148 R; 200/82 B; 60/634

[58] Field of Search ..... 200/148 R, 148 A, 150 R, 200/82 B; 60/634

[56] References Cited

U.S. PATENT DOCUMENTS

| | | | |
|---|---|---|---|
| 2,096,619 | 10/1937 | Prince | 60/634 |
| 2,436,194 | 2/1948 | Bush | 200/82 B |
| 2,476,024 | 7/1949 | Bush et al. | 60/638 |
| 2,480,553 | 8/1949 | Cooper et al. | 60/634 |
| 2,485,394 | 10/1949 | Logan | 200/82 B |
| 2,552,358 | 5/1951 | Whitney et al. | 200/148 R |
| 2,578,204 | 12/1951 | Peek | 200/82 B |
| 2,913,559 | 11/1959 | Cromer | 200/82 B |
| 3,210,931 | 10/1965 | Elzufon et al. | 60/634 |
| 3,286,460 | 11/1966 | Stadler et al. | 60/634 |
| 3,384,724 | 5/1968 | Marx et al. | 200/150 R |

*Primary Examiner*—Robert S. Macon
*Attorney, Agent, or Firm*—L. P. Johns

[57] ABSTRACT

A circuit interrupter characterized by a pair of separable contacts with operating means for opening and closing the contacts and comprising a cylinder and piston mechanism which cylinder has opening means at each end of the cylinder chamber. Rotatable means are provided at each end of the cylinder and have a plurality of spaced chambers which are sequentially alignable with the opening means. Means are also provided in each chamber for generating a sudden expulsion of gas against the piston and the rotatable means at each end of the cylinder being simultaneously rotatable. The circuit interrupter is also characterized by an adapter means for converting the gas from a high to low pressure status to operate the piston.

16 Claims, 7 Drawing Figures

CIRCUIT INTERRUPTER

CROSS-REFERENCE TO RELATED APPLICATIONS

This application is related to the applications Ser. No. 762,542, filed Jan. 26, 1977, and Ser. No. 831,722, filed Sept. 9, 1977. It is a continuation-in-part of the application Ser. No. 762,543, filed Jan. 26, 1977, now abandoned.

BACKGROUND OF THE INVENTION

1. Field of the Invention

This invention relates to a circuit interrupter operating mechanism, and more particularly, it pertains to a mechanism for feeding a gas to a piston-cylinder drive mechanism for opening and closing contacts in a circuit interrupter such as an oil circuit breaker.

2. Description of the Prior Art

Certain types of circuit interrupters, such as the so-called "puffer" circuit breaker, have involved relatively slow contact-opening time periods. Attempts to reduce the opening times have met with some success. For example, U.S. Pat. Nos. 2,096,619, 2,436,194, 2,476,024 and 2,552,358 disclose typical means for expediting the opening and/or closing of contacts in circuit breakers.

Inasmuch as circuit breakers of this type involve the use of various mechanical linkage systems, it is necessary to initiate movement of the system as soon as possible when an overcurrent occurs. At such times, most mechanical devices for initiating the opening of contacts, have been unsatisfactory due to the time lost in applying forces once the signal to open occurs. Indeed, most recent innovations using electrical ignition, although usually faster, still involve an ignition time which is slower than desirable. Thus, the so-called "bridge-wire" type of primer, comprising a resistance wire which directly or indirectly ignites a propellant, involves an ignition time of one to three milliseconds. Faster ignition times are desirable in order to open contacts when overcurrents occur.

Associated with the foregoing is the phenomenon of certain types of power circuit breakers operating through an "open-close-open" or "close-open-close" duty cycle in a fast sequence. For example, when a circuit breaker opens, it can immediately reclose and will stay closed where an overcurrent such as a short circuit clears before it recloses. However, where a short circuit continues, the circuit breaker will immediately open again, thus completing the open-close-open duty cycle. However, a circuit breaker may have the close-open-close duty cycle whereupon the foregoing procedure is reversed. One problem inherent in such duty cycles is the use of ancillary means for actuating a cylinder and piston mechanism that opens and closes the contacts. More particularly, the time for the piston to move through one motion is the time allowed for the ancillary means to prepare for the next function resulting in either the opening or closing of the contacts. Most ancillary means of prior construction have limited the duty cycle operation time.

Finally, the conventional pneumatic cylinder and piston mechanism for opening and closing the contacts of a circuit interrupter have been of the low pressure type which operates at from 100 to 1000 psi. In order to facilitate the opening and closing of the contacts of the circuit interrupter, most propellants currently available for operating the cylinder-piston mechanisms operate at very high pressures of about 6000 psi to enable the propellant to burn. This large pressure results in lower gas volume requirements; thus, flow time necessary for operation is much improved.

SUMMARY OF THE INVENTION

In accordance with this invention, it has been found that improvements in the operation time of circuit interrupters may be obtained by providing a circuit interrupter having a pair of separable contacts, operating means for opening and closing the contacts and comprising a cylinder and piston mechanism, the cylinder having opening means at each end of the cylinder chamber, rotatable means at each end of the cylinder and having a plurality of spaced chambers successively alignable with the opening means, the rotatable means comprising a pair of first revolving cylinders at one end of the cylinder and piston mechanism and a pair of second revolving cylinders at the other end of the mechanism, and one of the revolving cylinders at opposite ends of the mechanism being interconnected for simultaneous rotation and the other revolving cylinder at opposite ends being similarly interconnected.

The invention also comprises an electric circuit interrupter of the type set forth above in which a surge tank is connected to each opening means and communicates with the corresponding cylindrical chamber, a firing compartment communicates with and has a volume substantially less than that of the surge tank, pressure-dependent generator means in the firing compartment for generating a sudden expulsion of gaseous medium in the compartment, and there being a restrictive opening between the compartment and the tank, whereby gaseous pressure is maintained at a sufficient level within the compartment to maintain a high burning rate for the pressure-dependent generator means.

The invention also comprises an electric circuit interrupter of the type set forth above in which a piston cylinder is connected to each opening means, a firing compartment communicates with the piston cylinder, pressure-dependent generator means in the firing compartment for generating a sudden expulsion of gaseous medium in the piston cylinder, whereby gaseous pressure is maintained at a sufficient level within the piston cylinder to maintain a high burning rate for the pressure-dependent generator means.

The advantage of the circuit interrupter of this invention is that it provides for the operation of the circuit breaker in either an open-close-open or close-open-close duty cycle by using propellants to operate a cylinder-piston mechanism without involving time-consuming operation of auxiliary means. It enables the use of a high pressure burning propellant to operate a low pressure cylinder-piston mechanism, and it enables the use of a high pressure gas of low volume to operate a high pressure cylinder-piston mechanism.

DESCRIPTION OF THE PREFERRED EMBODIMENTS

Figure 1:
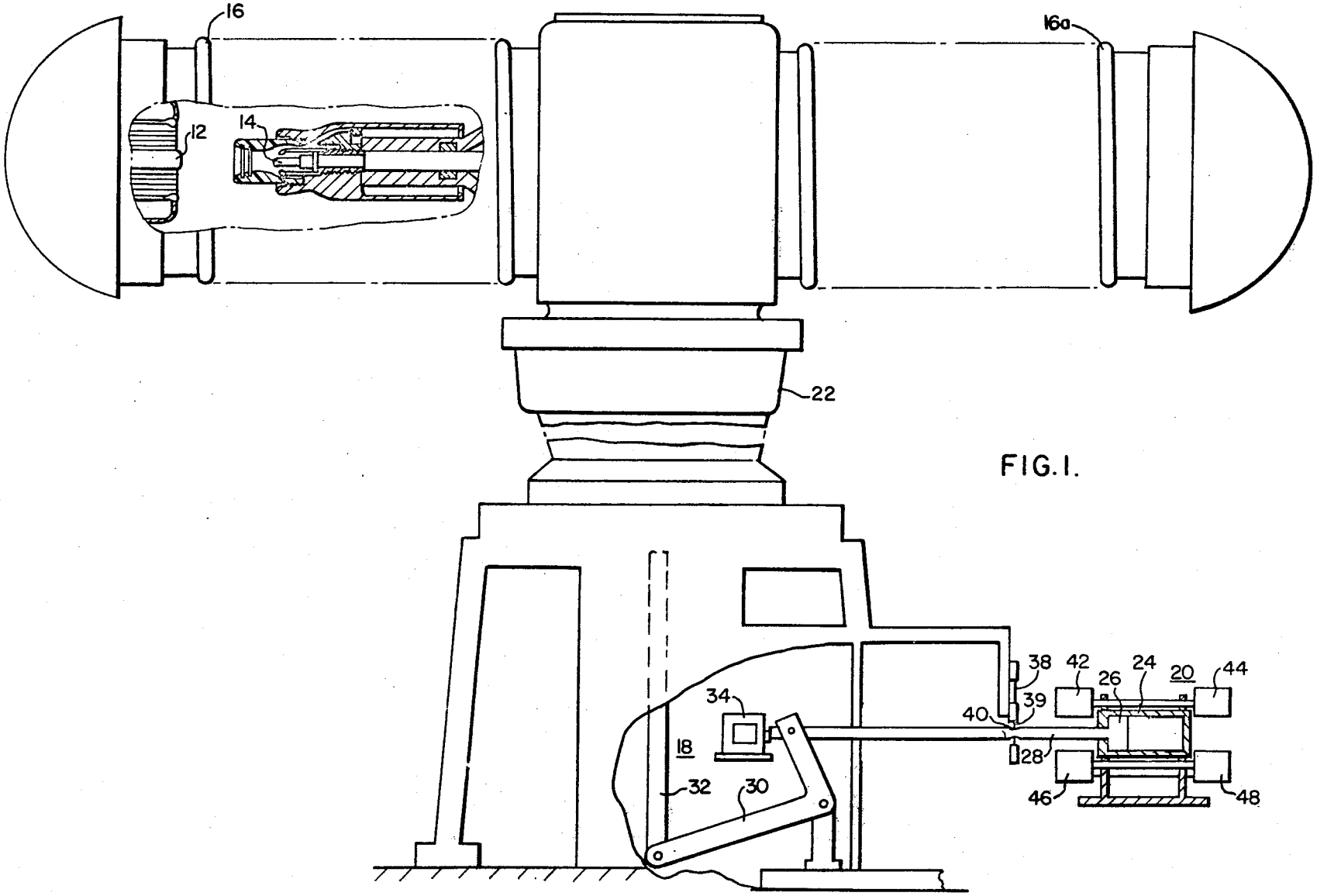
FIG. 1 is a schematic elevational view, partly in section, showing a puffer-type circuit interrupter in the open position.
Figure 2:
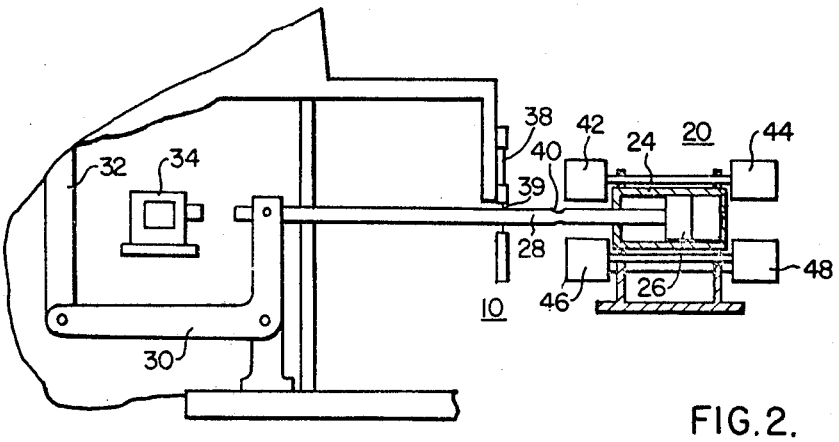
FIG. 2 is a fragmentary sectional view showing the operating mechanism of the interrupter in the closed position.

A circuit interrupter of the compressed gas puffer-type is generally indicated at 10 in FIG. 1 and it comprises a pair of separable contacts 12, 14 which are contained within an insulating casing 16, operating means 18 for opening and closing the contacts, and means 20 for generating a sudden expulsion of gaseous medium for opening the contacts. The circuit interrupter 10 is similar to that disclosed in the above-mentioned application Ser. No. 762,542. The pair of contacts 12, 14 are similar to corresponding contacts (not shown) in the casing **16*a*. Both casings 16, 16*a* are supported on an upright support 22 of insulating material similar to the casings 16, 16*a***, such as porcelain.

The operating means 18 comprises a cylinder-piston assembly including a cylinder 24, a piston 26, a piston shaft 28, lever means 30, and connecting link 32 for moving the contacts 12, 14 between open and closed positions in a conventional manner.

Generally, when the piston 26 is moved to the left of the cylinder 24 (FIG. 1), the piston rod 28 rotates the bell crank lever 30 counterclockwise to pull the link 32 down and open the contacts 12, 14. A shock absorber 34 is preferably provided at the left end of the rod 28. A latch 38 is provided to hold the circuit interrupter 10 in the open position at the completion of the opening stroke. The latch 38 is a mechanism operated either by a solenoid, or magnetic repulsion coils, which comprises a plunger 39 which engages a notch 40 in the piston rod 28. The latch may also be located at any other portion of the operating means 18, such as in conjunction with the bell crank lever 30 or the link 32.

Figure 5:
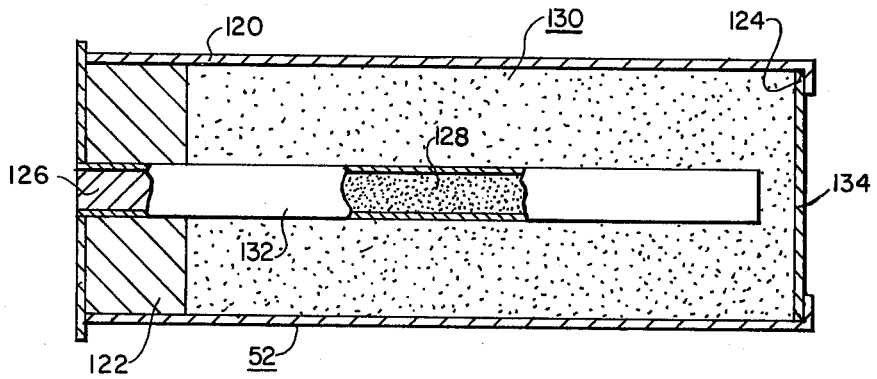
FIGS. 5 and 6 are enlarged sectional views of two embodiments of the propellant cartridge.

The generator means 20 comprises a plurality of pairs of cartridge-supply cylinders 42, 44, 46, and 48 having a number of spaced cartridge chambers 50 (FIG. 3) in which cartridges 52 of solid expulsive material are disposed. The cartridges are similar to the propellant cartridges disclosed in the above-mentioned application Ser. No. 762,542, or the cartridges may be of the type set forth in FIG. 5 below. As the cylinders 42–48 are rotated, the chambers 50 of each cylinder are brought in alignment with corresponding inlet openings 54, 56, 58, and 60 (FIG. 3) in the end walls 62, 64 of the cylinder 24. Each opening 54–60 comprises a one-way valve (not shown) to prevent back-flow of hot gas into the charge cartridge 52. Each chamber 50 is in a gas-tight connection with the corresponding opening 54–60, so that when the particular cartridge 52 involved with the opening is fired, the resulting expulsive gas produced fills the cylinder chamber and drives the piston 26.

The cylinders 42, 44 are mounted on a shaft 66 (FIG. 3) which is rotatably mounted in journals 68. Likewise, the cylinders 46, 48 are mounted on a shaft 70 on the same journals. The shaft 66 is rotated by a pretorqued spring 72 and the shaft 70 is mounted in a similar spring 74.

Figure 3:
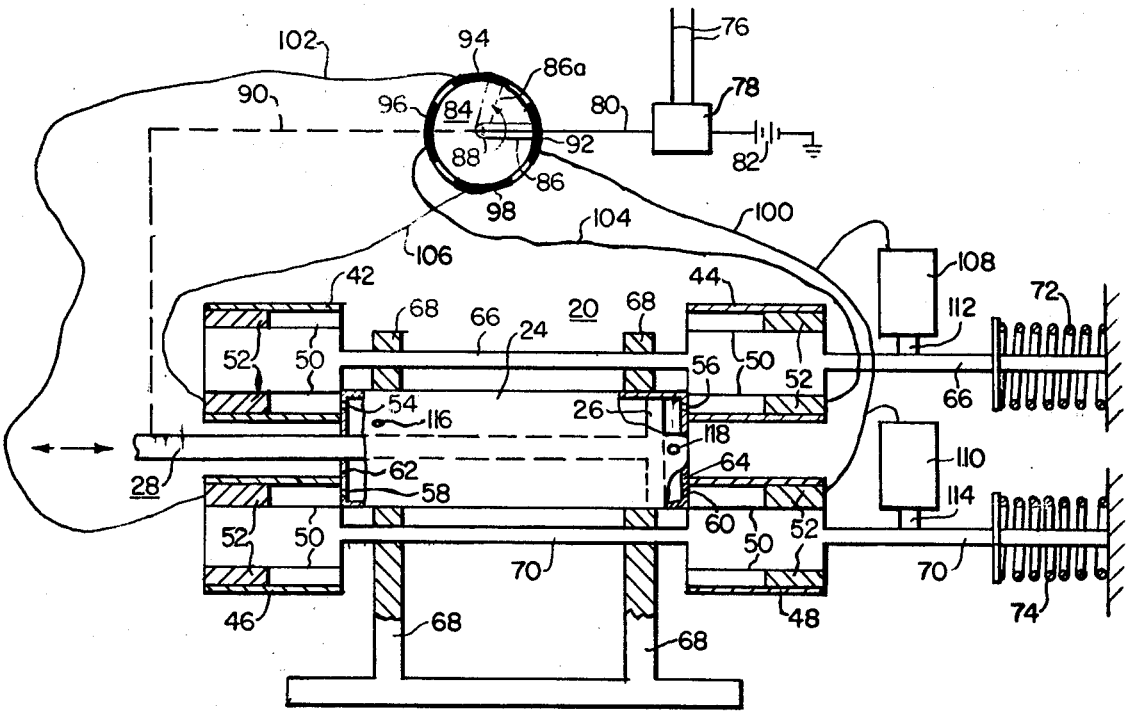
FIG. 3 is a schematic sectional view showing auxiliary firing means for propellants for driving the cylinder-piston mechanism.

In accordance with this invention, when an overcurrent condition, such as a short circuit, occurs, an electrical signal is transmitted through conductors 76 to a pulse switch 78 in order to actuate a circuit 80 including a source of DC current such as a battery 82. A firing distributor 84 comprises a rotatable arm 86 pivoted at 88. As indicated by the broken line 90, the arm 86 is operatively connected to the piston shaft 28, whereby each movement of the piston 26 to the right or left moves the arm 86 counterclockwise. The outer end of the arm 86 is successively moved through an arc of 360 degrees in which a plurality of, such as four, spaced contacts 92, 94, 96, and 98 are disposed, the number of which contacts is equal to the number of cylinders 42–48. The contacts 92, 94, 96, 98 are connected by conductors 100, 102, 104, and 106, respectively, to locations where the cartridges 52 are successively positioned for firing (FIG. 3).

In addition, the conductors 100, 104 are connected to cylinder latching mechanisms 108, 110, respectively, for releasing the appropriate shaft 66, 70 to enable the pretorqued spring 72 or 74 to rotate the shaft through one position to present another chamber 50 containing an unfired cartridge 52, ready for the next firing cycle. For that purpose, the latching mechanisms 108, 110 are suitably provided with means for enabling rotation of each shaft 66, 70 through one firing position of the cylinders. Such means may include solenoid-operated plungers 112, 114 each of which is operatively associated with the shaft 66, 68 to release or stop rotation thereof. For example, each plunger 112, 114 may be used with an annular ratchet (not shown) mounted on the shafts. Accordingly, when either mechanism 108, 110 is actuated, the corresponding plunger is retracted momentarily to permit the corresponding spring 72, 74 to rotate the shaft through one position of the cylinders, whereupon the plunger 112 or 114 returns to the next position in the ratchet.

An example of the manner in which the device of this invention operates is as follows: When an overcurrent occurs in the line in which the circuit interrupter 10 functions, the pulse switch 78 transmits a current to the contact 92 through the arm 86 and the conductor 100 to the cartridge 52 which is fired to send propellant gas through the opening means 60 into the cylinder chamber 24 to drive the piston 26 to the position of FIG. 1, and thereby open the contacts 12, 14. To facilitate movement of the piston 26 in either direction, exhaust ports 116, 118 are provided near opposite ends of the cylinder which ports are provided with valves (not shown) in a conventional manner to prevent escape of expulsion gas in the portion of the chamber being fired and to exhaust gases when the piston is at the end of the cylinder opposite that of the valve involved.

Usually, when an overcurrent occurs, it is of relatively short duration so that immediate closure of the contacts 12, 14 is usually appropriate. Manifestly, when the shaft 28 moves to the left (FIG. 3), the arm 86 rotates to the position **86*a* and closes a circuit through the conductor 102 to the cartridge 52 in the cylinder 46. The cartridge 52 is thereby fired and the resulting expulsive gas drives the piston 26 to the right, closing the contacts 12, 14**.

In the event that the overcurrent causing the original opening of the contacts 12, 14 is of longer duration than the usual short circuit, the pulse switch 78 sends a current through the arm 86 which is now positioned at the contact 96, whereupon the conductor 104 conducts the current to the cartridge 52 in the cylinder 48, thereby driving the piston 26 again to the left to open the contacts 12, 14. At the same time, the latching mechanism 110 is actuated to cause the cylinders 46, 48 to rotate one position to bring another pair of cartridges 52 into position. Accordingly, an open-close-open sequence is performed.

Figure 7:
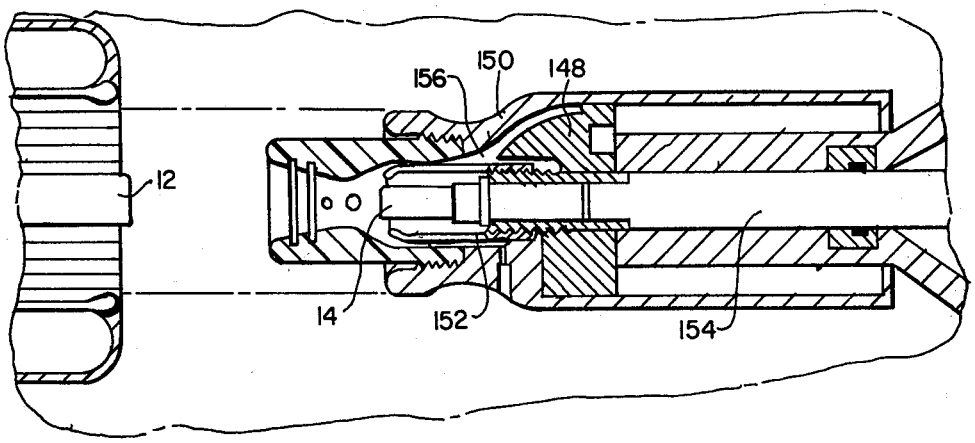
FIG. 7 is an enlarged fragmentary view of the contacts in the open position in a compressed gas puffer-type circuit interrupter.

Although the device of this invention may be used on various types of circuit interrupters, it is particularly useful when employed with the compressed gas puffer-type circuit interrupter as set forth in the above-mentioned patents. This results from the fact that puffer interrupters are presently slower than two pressure gas breakers. In order to achieve desired operating times (eg., two cycle interruption time), a more rapid actuator response is necessary. More particularly, as shown in FIG. 7, the pair of separable contacts 12, 14 contained within the casing 16 are substantially similar to the contact structures disclosed in the application, Ser. No. 685,466, filed May 12, 1976 (now U.S. Pat. No. 4,101,748). Like the compressed gas puffer-type circuit interrupter of that application, the contacts 12, 14 are operatively associated with arc extinguishing structure comprising a gas compressing piston part 148 which is operatively associated with a gas compressing cylinder part 150. The structure also comprises means defining a hollow movable orifice member 152 to assist in directing compressed gas against an arc (not shown) that may develop between the stationary contact 12 and the movable contact 14 when the latter is moved to the open position as shown in FIG. 7. The cylinder part 150, together with the movable contact 14, is mounted on the shaft 154 which is operatively connected to the connecting link 32. Accordingly, when the contact 14 moves to the open position (FIG. 7), a gas within a space 156 between the cylinder and piston parts 148, 150 is compressed and forced into the space between the separating contacts in order to facilitate in extinguishing an arc created during opening of the contacts.

Subsequently when the cause for the overcurrent is corrected, a signal is again transmitted to the pulse switch 78 which actuates the circuit 80 through the contact 98 and the conductor 106 to fire the cartridge 52 in the cylinder 42, thereby closing the circuit through the contacts 12, 14. Thus, the arm 86 is returned to its original position at the contact 92.

Accordingly, the circuit interrupter 10 having the generator means 20 including the cylinders 42–48 provides propellants for operating the piston in both directions. In addition, sufficient cartridges are stored for the normal operation of the circuit breaker between maintenance periods.

Each cartridge 52 is comprised of a casing 120 having a closed end wall 122 and an open end 124. Within the casing is a primer 126, and igniter 128, and a powder charge 130. The primer 126 is preferably actuated by an electric charge, such as described above (FIG. 3), to obtain the fastest possible action. The igniter 128 is contained within a tubular member 132 of relatively flimsy material, such as a paper straw, and is disposed within the powder charge 130. The igniter 128 is preferably composed of black powder, or a mixture of boron and potassium nitrate, and the powder charge 130 is preferably a smokeless powder charge. The primer 126 is actuated by an electrical discharge. The primer may consist of a fuse wire in a pyrotechnic material or a mixture of electrically sensitive material. A disc sealant 134 such as cardboard or plastic is provided in the open end of the cartridge casing 120 to retain the assembly intact. Each cartridge 52 is disposed in the end of the cartridge chamber 50 remote from the corresponding openings 54–60, which are substantially smaller than the cross section of each cartridge 50. In order to provide and maintain a pressure within the chamber 50 for a short time to obtain full and complete ignition of the powder charge 130 and obtain a heat transfer dependent reaction of high pressure. As the expulsive gas created within the chamber 50 passes through the orifices 54–60 into the larger cylinder chamber, the gas assumes a lower pressure conducive to movement of the low pressure cylinder 26.

However, the pressure may be varied with the size of the openings 54–60. Where the openings are relatively large the expulsion gas is transmitted to the cylinder chamber faster, so that the response is quicker than where the openings are smaller.

Figure 6:
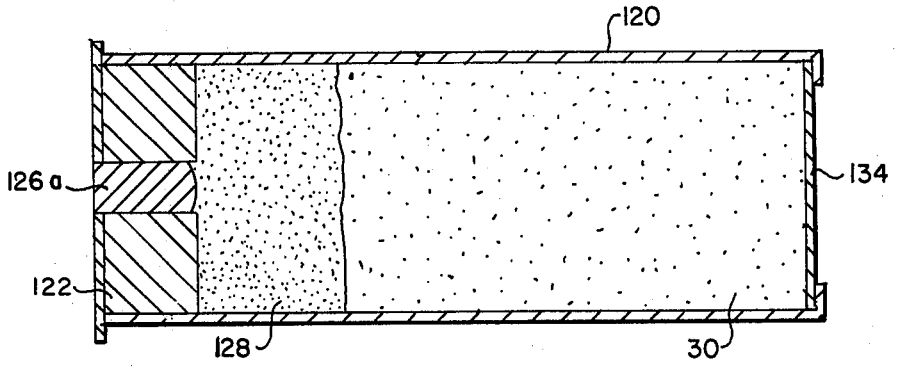

Another embodiment of the cartridge 52 is shown in FIG. 6 in which similar numbers refer to similar materials. Only the primer **126*a* differs from the primer 126 in that the former is shorter and does not comprise an elongated tubular member 132. Otherwise, the igniter powder 128 is distributed between the powder charge 130 and the primer 126*a*** as shown in FIG. 6.

Figure 4:
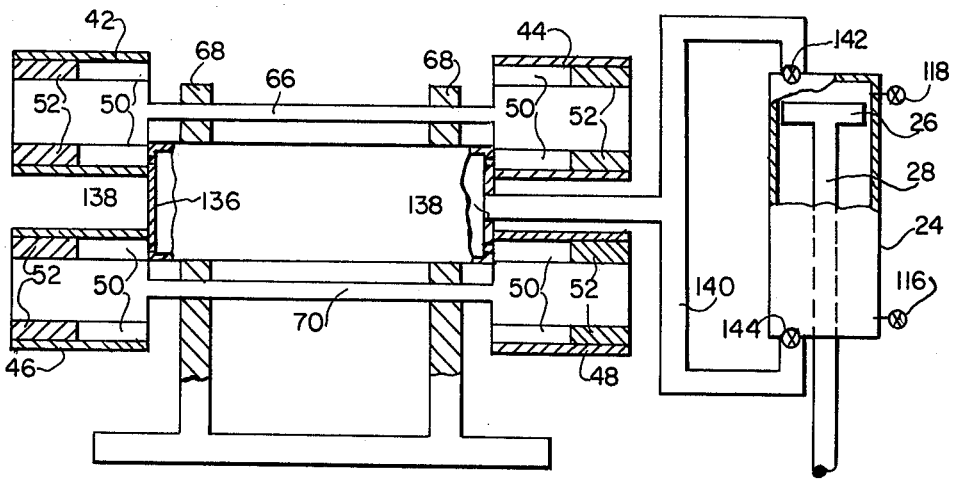
FIG. 4 is a schematic fragmentary alternate means with propellants driving the cylinder-piston mechanism.

Another embodiment of the generator means 20 together with the cylinder-piston mechanism as well as the cylinders 42–48 is shown in FIG. 4 in which similar parts have reference numbers similar to those of FIG. 3. Other auxiliary members such as the firing distributor 84, the latching mechanisms 108, 110, and the pretorqued springs 72, 74 are omitted for clarity. The embodiment of FIG. 4 differs from that in FIG. 3 in that the former includes a large surge tank 136 having a plurality of orifices 138 provided for each of the cylinders 42–48 similar to the openings 54–60 of FIG. 3. Each orifice 138 comprises a one-way valve (not shown) to prevent back-flow of hot gas into the charge cartridge 52. Inasmuch as the cartridges 52 are pressure dependent to create high pressure expulsive gas and the cylinder-piston mechanism operates at low pressure, each cartridge 52 as fired empties through its corresponding orifice 138 into the surge tank 136 which in turn communicates with opposite ends of the cylinder 24 through the conduit ends 140. One-way valves 142, 144 are provided between the communications points of the cylinder 24 and each branch portion of the conduit means 140. The exhaust port 116 and the valve 142 are synchronized to open simultaneously. Likewise, the exhaust port 118 and the valve 144 are synchronized to open together. Accordingly, the embodiment of the device shown in FIG. 4 shows another manner of providing a restrictive opening, such as orifices 138 between the high pressure cartridge chamber 50 and the low pressure cylinder of the cylinder-piston mechanism 24.

What is claimed is:

1. An electric circuit interrupter comprising a pair of separable contacts, operating means for opening and closing the contacts and comprising a cylinder and piston mechanism, the cylinder having opening means at each end of the cylinder, rotatable means at each end of the cylinder and having a plurality of spaced chambers successively alignable with the opening means, generator means in each chamber for generating a sudden expulsion of gaseous medium against the piston and comprising a propellant charge, igniter means for the generator means, and means for rotating the rotatable means.

2. The electric circuit interrupter of claim 1 in which the rotatable means comprise a first revolving cylinder at one end of the cylinder and piston mechanism and a second revolving cylinder at the other end of the mechanism.

3. The electric circuit interrupter of claim 2 in which the first and second revolving cylinders are interconnected to effect simultaneous rotation.

4. The electric circuit interrupter of claim 1 in which the rotatable means comprise a pair of first revolving cylinders at one end of the cylinder and piston mechanism and a pair of second revolving cylinders at the other end of the mechanism.

5. The electric circuit interrupter of claim 4 in which one of the revolving cylinders at opposite ends of the mechanism is interconnected for simultaneous rotation and the other of the revolving cylinders at opposite ends being similarly interconnected.

6. An electric circuit interrupter comprising a pair of separable contacts, operating means for opening and closing the contacts and comprising a cylinder and piston mechanism, the cylinder having opening means at each end of the cylinder chamber, a surge tank connected to each opening means and communicating with the cylinder chamber, a firing compartment communicating with and having a volume substantially less than that of the surge tank, pressure-dependent generator means in the firing compartment for generating a sudden expulsion of gaseous medium in the compartment, and a restrictive opening between the compartment and the tank, whereby gaseous pressure is maintained at a sufficient level within the compartment to maintain a high burning rate for the pressure-dependent generator means.

7. The electric circuit interrupter of claim 6 in which the compartment is a barrel-like compartment in which the generator means is disposed at one end and the restrictive opening being disposed at the other end and adjacent to the chamber.

8. A compressed gas puffer-type circuit interrupter comprising, in combination:

(a) means defining a gas-compressing piston part;
(b) means defining a gas-compressing cylinder part;
(c) means defining a relatively stationary contact;
(d) means defining a cooperable relatively-movable contact cooperable with said relatively stationary contact to establish an arc therebetween during the opening operation of the puffer-type circuit interrupter;
(e) means defining a hollow movable orifice member to assist in directing compressed gas against said established arc;
(f) means attaching said hollow movable orifice member and also said relatively movable contact with one of said gas-compressing parts;
(g) operating means utilizing ignition means for operating said compressed gas puffer-type circuit interrupter and thereby effecting relative motion between said two gas-compressing parts for thereby compressing gas therebetween and thus forcing said compressed gas through said hollow movable orifice and into engagement with the established arc to quickly effect the latter's extinction; and
(h) the operating means comprising a cylinder-piston mechanism with rotatable means at each end of the cylinder and having a plurality of spaced chambers communicative with the cylinder chamber and containing the combustible propellant.

9. The compressed gas puffer-type circuit interrupter of claim 8 in which the rotatable means comprises a first revolving cylinder at one end of the cylinder and piston mechanism and a second revolving cylinder at the other end of the mechanism.

10. The compressed gas puffer-type circuit interrupter of claim 9 in which the first and second revolving cylinders are interconnected to effect simultaneous rotation.

11. The compressed gas puffer-type circuit interrupter of claim 10 in which the rotatable means comprises a pair of first revolving cylinders at one end of the cylinder and piston mechanism and a pair of second revolving cylinders at the other end of the mechanism.

12. The compressed gas puffer-type circuit interrupter of claim 11 in which one of the revolving cylinders at opposite ends of the mechanism are interconnected for simultaneous rotation and the other of the revolving cylinders at opposite ends being similarly interconnected.

13. An electric circuit interrupter comprising a pair of separable contacts, operable means for opening and closing the contacts and comprising a cylinder and piston mechanism, the cylinder having opening means at each end of the cylinder chamber, container means for introducing compressed gas into the cylinder alternatively through the opening means, ignition means for providing a compressed gas medium within the container means, and movable means operatively connected to the container means, and comprising spaced compartments in which the ignition means are located for sequential firing into the container means.

14. The electric circuit interrupter of claim 13 in which the container means comprises a plenum container communicating with the opening means at each end of the cylinder chamber and valve means for alternatively opening the opening means at each end of the cylinder chamber.

15. The electric circuit interrupter of claim 14 in which the movable means comprises a first revolving cylinder at one end of the container means and a second revolving cylinder at the other end of the container means.

16. The electric circuit interrupter of claim 15 in which the first and second revolving cylinders are interconnected to effect simultaneous rotation.

* * * * *